United States Patent [19]

Pelczar

[11] Patent Number: 4,811,946

[45] Date of Patent: Mar. 14, 1989

[54] WEIGHT LIFTING APPARATUS

[76] Inventor: Stanley J. Pelczar, 259 Woodmont Dr., East Hartford, Conn. 06118

[21] Appl. No.: 169,935

[22] Filed: Mar. 18, 1988

[51] Int. Cl.[4] ..... A63B 21/00

[52] U.S. Cl. ..... 272/129; 272/125; 272/133; 272/134; 272/135; 272/136; 272/138; 272/DIG. 4; 272/DIG. 5

[58] Field of Search ..... 272/118, 125, 129, 131, 272/132, 133, 134, DIG. 4, DIG. 5, 116, 135, 136, 138

[56] References Cited

U.S. PATENT DOCUMENTS

| | | | |
|---|---|---|---|
| 3,848,467 | 11/1974 | Flavell | 272/DIG. 5 X |
| 3,871,646 | 3/1975 | Slack | 272/DIG. 4 |
| 3,885,789 | 5/1975 | Deluty et al. | 272/133 |
| 4,010,948 | 3/1977 | Deluty | 272/133 |
| 4,082,267 | 4/1978 | Flavell | 272/125 |
| 4,208,049 | 6/1980 | Wilson | 272/138 |
| 4,600,196 | 7/1986 | Jones | 272/136 X |
| 4,678,184 | 7/1987 | Neiger et al. | 272/129 |
| 4,691,918 | 9/1987 | Rockwell | 272/134 |
| 4,714,244 | 12/1987 | Kolomsyets et al. | 272/135 X |

*Primary Examiner*—Richard J. Apley
*Assistant Examiner*—Joe H. Cheng
*Attorney, Agent, or Firm*—Fishman, Dionne & Cantor

[57] ABSTRACT

An electro-mechanical weight lifting device is presented which allows a person to excercise by selecting a desired weight electronically. The present invention comprises a plurality of tension spring units (known as arbor mounted reels) on a frame. Preferably, eight tension spring units including four 50 pound, two 20 pound, one 10 pound and one 5 pound unit, are provided. Cables from the spring units are attached to a lifting arm which is pivotably mounted on the frame. The present invention further includes a digital key pad, digital display unit, selector solenoid unit, selectors, power supply and electronic logic. During operation, a weight is selected by activating the key pad whereupon the weight is displayed. The electronic logic then detects the key pad entry and energizes the selector solenoids which engage selectors for actuating a combination of tension springs. If a different weight is desired, a reset button on the key pad is used to disengage the selector units thereby allowing for a new combination of weights. An important feature of the present invention is the novel use of plurality of tension spring units. The tension spring units are small and compact, and provide certain advantages over the conventional use of actual metal weights in weight lifting machines.

14 Claims, 9 Drawing Sheets

WEIGHT LIFTING APPARATUS

BACKGROUND OF THE INVENTION

This invention relates generally to an apparatus for exercising and weight lifting. More particularly, this invention relates to a new and improved weight lifting apparatus utililizing a combination of tension springs and electronics which permits the user to select a desired lifting weight electronically.

For some time now, exercise has become increasingly important as a means to ensure and maintain good health. This interest in exercise has fostered a new found awareness of the human body and the physique. Because of this interest in achieving a healthy, weight controlled and toned body, weight lifting has become quite popular.

As is well known, weight lifting devices have traditionally consisted of either free weights or purely mechanical machines wherein a series of pulleys, cables and metal weights are used to alter the amount of weight.

SUMMARY OF THE INVENTION

The present invention relates to an electro-mechanical weight lifting device which allows a person to excercise by selecting a desired weight electronically. The present invention comprises a plurality of tension spring units (known as arbor mounted reels) on a frame. Preferably, eight tension spring units including four 50 pound, two 20 pound, one 10 pound and one 5 pound unit, are provided. The cables from the spring units are attached to a lifting arm which is pivotably mounted on the frame. The present invention further includes a digital key pad, digital display unit, selector solenoid unit, selectors, power supply and electronic logic.

During operation, a weight is selected by activating the key pad whereupon the weight is displayed. The electronic logic then detects the key pad entry and energizes the selector solenoids which engage selectors for actuating a combination of tension springs. If a different weight is desired, a reset button on the key pad is used to disengage the selector units thereby allowing for a new combination of weights.

An important feature of the present invention is the novel use of a plurality of tension spring units. The tension spring units are small and compact, and provide certain advantages over the conventional use of actual metal weights in weight lifting machines.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
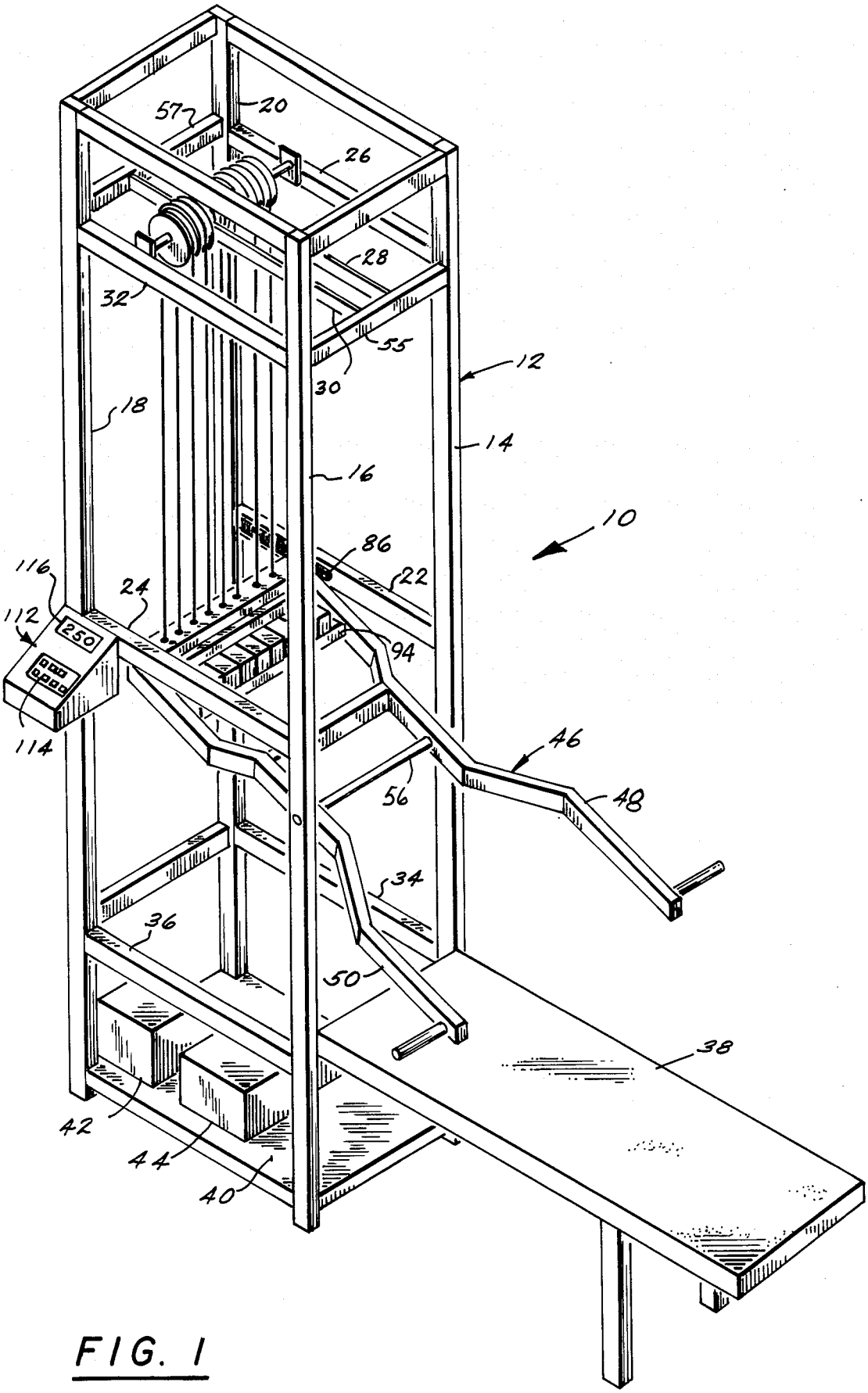
FIG. 1 is a perspective view of the weight lifting apparatus in accordance with the present invention.

Referring first to FIG. 1, a weight lifting device in accordance with the present invention is shown generally at 10. Weight lifting device 10 comprises a rigid frame 12 having four legs 14, 16, 18 and 20 which are mounted on the floor. Frame 12 further includes central cross arms 22 and 24 and upper cross arms 26, 28, 30 and 32. A pair of lower cross arms 34 and 36 provide support to the legs and also support a bench 38. Finally, frame 12 includes an electronic table 40 which supports a power supply 42 and an electronics logic unit 44 as will be discussed hereinafter. It will be appreciated that frame 12 may be enclosed in a cabinet (such as plexiglass or the like) to provide an aesthetically pleasing unit.

Referring simultaneously now to FIGS. 1–4, a lifting unit 46 comprised of a pair of opposed arms 48 and 50 are mounted via a pivot pin 52 and a pair of bushings 54 between legs 14 and 16 of frame 12. As a result, lifting unit 46 will pivot on frame 12 about pivot pin 52 which remains stationary in the position shown on frame 12. Preferably, a sleeve 56 is provided between arms 48 and 50 which receives pivot pin 52.

Cross arms 26, 28, 30 and 32 and lateral supports 55 and 57 define a tension unit support 58 (see FIG. 2) for supporting a plurality of spring loaded tension units, eight of which are illustrated in the FIGURES. The tension units include two twenty pound units 60, four 50 pound units 62, one ten pound unit 64 and one five pound unit 66. All of these units 60, 62, 64 and 66 are keyed to a non-rotatable shaft 68 mounted on tension unit support 58 via a pair of opposed mounting units 70.

Figure 5:
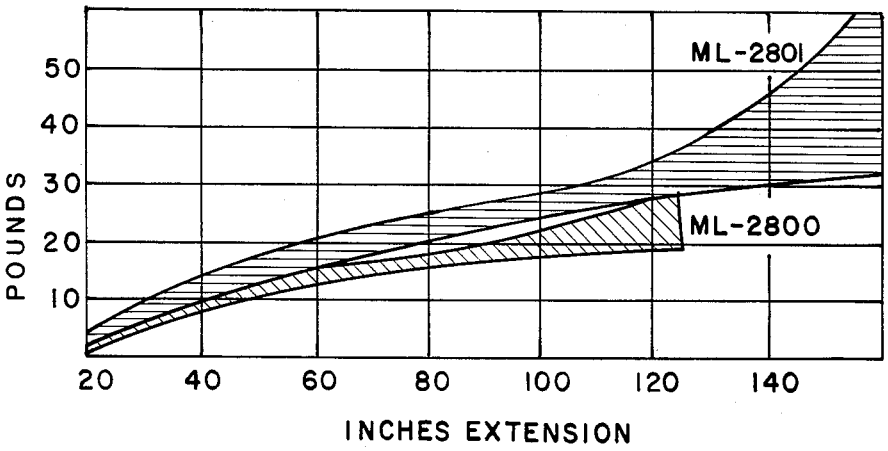
FIG. 5 is a graph showing cable pull (lbs.) versus inches extension for a tension spring unit such as shown in FIG. 2A.

Tension spring units 60 through 66 are conventional and have a well known mechanical configuration. An enlarged perspective view of a typical tension spring unit is shown at 60' in FIG. 2A and comprises a metal reel 72 having a length of nylon coated galvanized steel cable 74 wrapped on reel 72. Reel 72 is mounted for rotation on shaft 68 via an arbor 76 which is preferably comprised of a Delrin polymeric material. The cable 74 terminates at an annular hold-down 78. It will be appreciated that cable 74 is spring loaded such that a downward force on cable 74 will bias the internal spring. Consequently as cable 74 is extended, an opposite force or cable pulling force will increase as shown by the able in FIG. 5. In a preferred embodiment, the arbor mounted reel 60' used in conjunction with the present invention is an Ametek arbor mounted reel, model number ML-2801 and ML-2800, manufactured by Hunter Spring Products of Sellersville, Pa.

Lifting unit 46 includes a pair of handles 80 at a first end. At the end opposite the first end, lifting unit 46 terminates at a fork. Connected between the fork is a selector base unit 82 having a series of spaced apertures 84 therethrough. It will be appreciated that the opposed inside faces of intermediate cross arms 22 and 24 include aligned and opposed channels 86 (see FIG. 4). The selector base unit 82 is mounted in the opposed channels 86 by a pair of rotary bearing units 88 and 90 so that selector base unit 82 can freely travel back and forth along channels 86.

Figures 2, 2A:
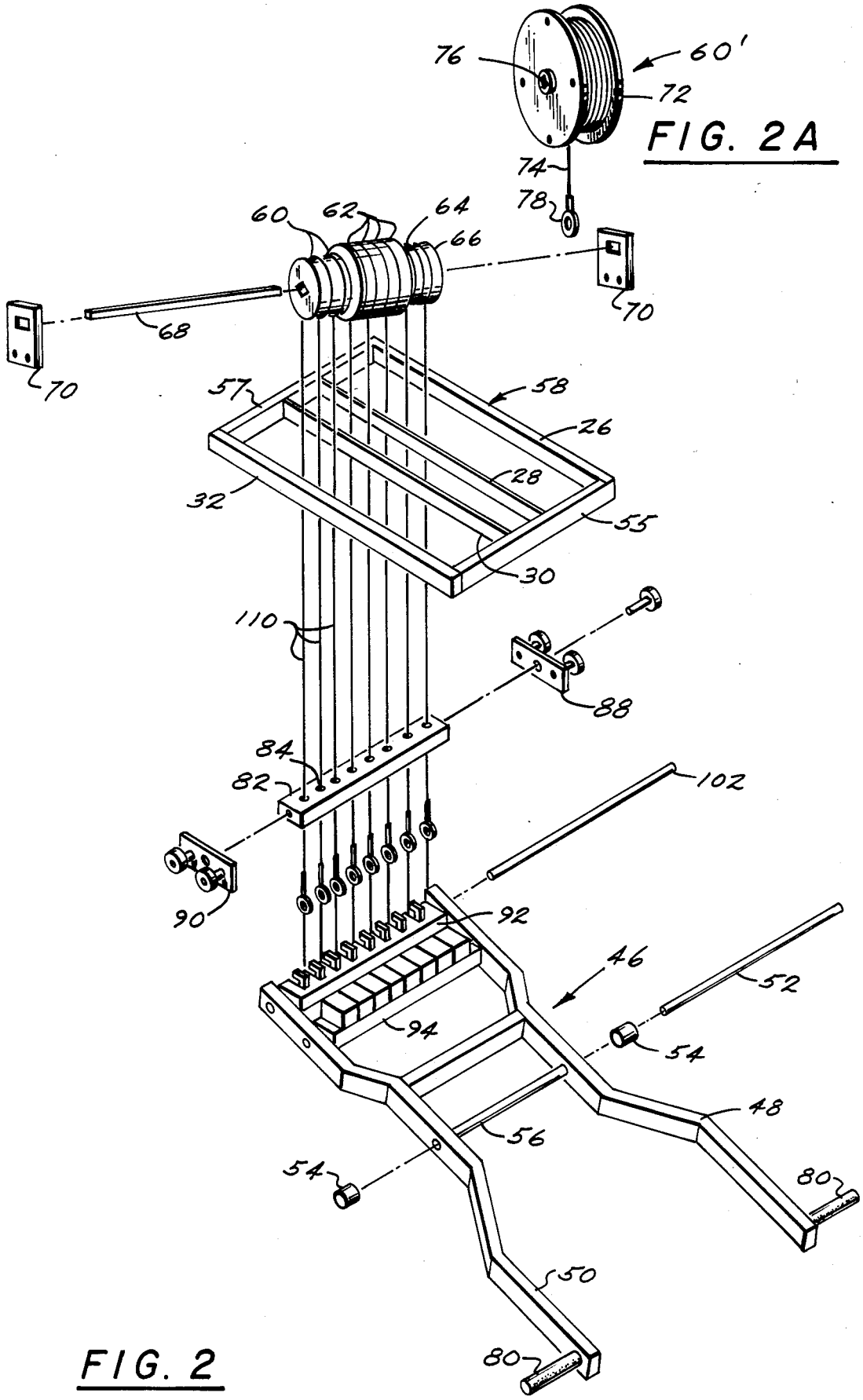
FIG. 2 is an exploded view of the mechanical portion of the weight lifting apparatus of FIG. 1.
FIG. 2A is a perspective view of a tension spring unit of the type shown in FIG. 1.

Also mounted between the fork of lifting unit 46 is a selector arm unit 92 and a solenoid selector unit 94. Selector arm unit 92 includes a plurality of spaced selector arms 96 which are aligned with and correspond to the plurality of apertures 84 through selector base unit 82. Each selector arm 96 comprises a longitudinal shaft having a lateral extension 98. Selector arms 96 are pivotally mounted in recesses 100 of selector arm unit 92 by a selector arm pivot pin 102 as shown in FIG. 2. In turn, pivot pin 102 is rigidly mounted within the fork section of lift unit 46. Similarly, solenoid selector unit 94 is also rigidly mounted on arm unit 46 in the fork section as shown in FIGS. 1 and 2. Solenoid selector unit 94 includes a plurality of solenoid units 104 which ultimately correspond to the number of spring tension units 60 through 66. Each solenoid unit 104 has a conventional and well known construction and includes a lateral solenoid arm 106 extending therefrom which is pivotably connected to that end of each selector arm 96 which is opposed from lateral extension 98 defining pivot point 108. A return spring 109 surrounds a portion of each lateral solenoid arm 106. Return spring 109 acts to disengage selector arm 96 from annular hold down 78. Preferably, solenoid unit 104 is a general purpose D.C. solenoid (24 volt, 11.5 watt) such as model S4H Series manufactured by P & P, Inc.

Figure 3:
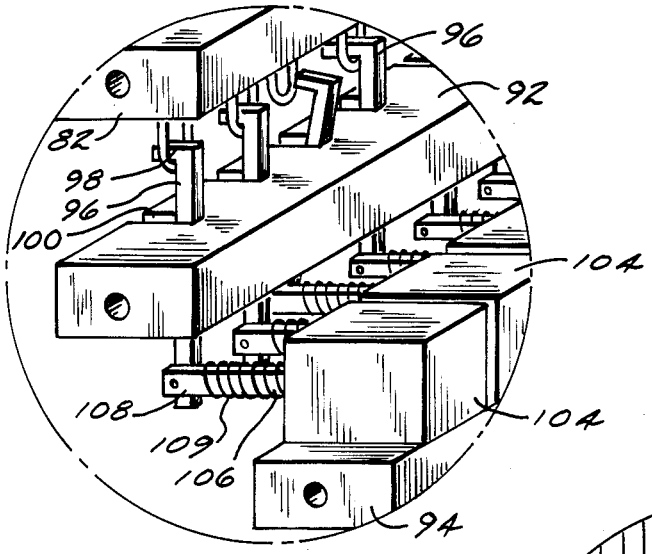
FIG. 3 is an enlarged perspective detailed view of a portion of FIG. 2.
Figure 4:
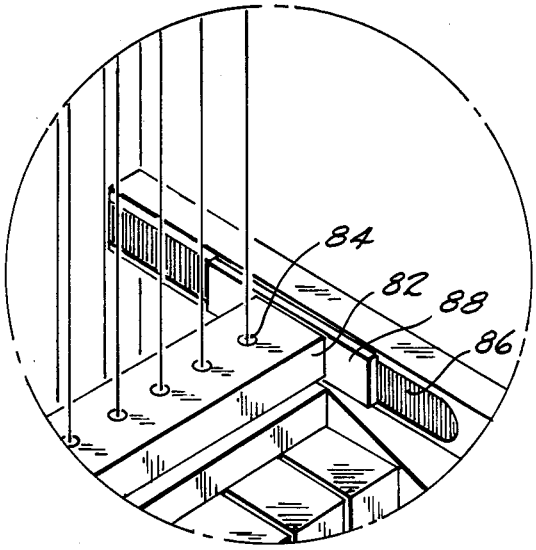
FIG. 4 is an enlarged perspective detailed view of another portion of FIG. 2.

As is clear from a review of the FIGURES, each of the cables 110 from spring tension units 60 through 66 are threaded through apertures 84 of selector base unit 82 whereupon annular hold downs 78 are mated with the lateral extension 98 of a corresponding selector arm 96 (see FIG. 3).

Attached to frame 12 is a weight selector and display unit 112 which includes a digital key pad 114 and a digital display 116. Weight selector and display unit 112 communicates with the electronic logic unit 44.

The electronics portion of the present invention which consists of the electronics logic unit 44, the power supply 42, the weight selector and display unit 112 and the interaction thereof with the solenoid selector unit 94 will now be discussed.

It will be appreciated that the electronics for the electronic weight lifting device of the present invention enables a person to select the desired weight to start excercising, giving also visual indication of the selection made. It has been designed using integrated circuit chips and other discrete components such as resistors, transistors, etc. The electronic logic unit 44 houses the logic circuit. The main function of the logic circuit is to energize the mechanical solenoids 104 which in turn engage the appropriate spring tension units 60–66 whose tension is equivalent to the selected weight. The primary section of the logic circuit includes a latching section (FIG. 6), an encoding section (FIG. 7), a solenoid drive section (FIGS. 10 and 11) and a power supply 42.

Figure 6:
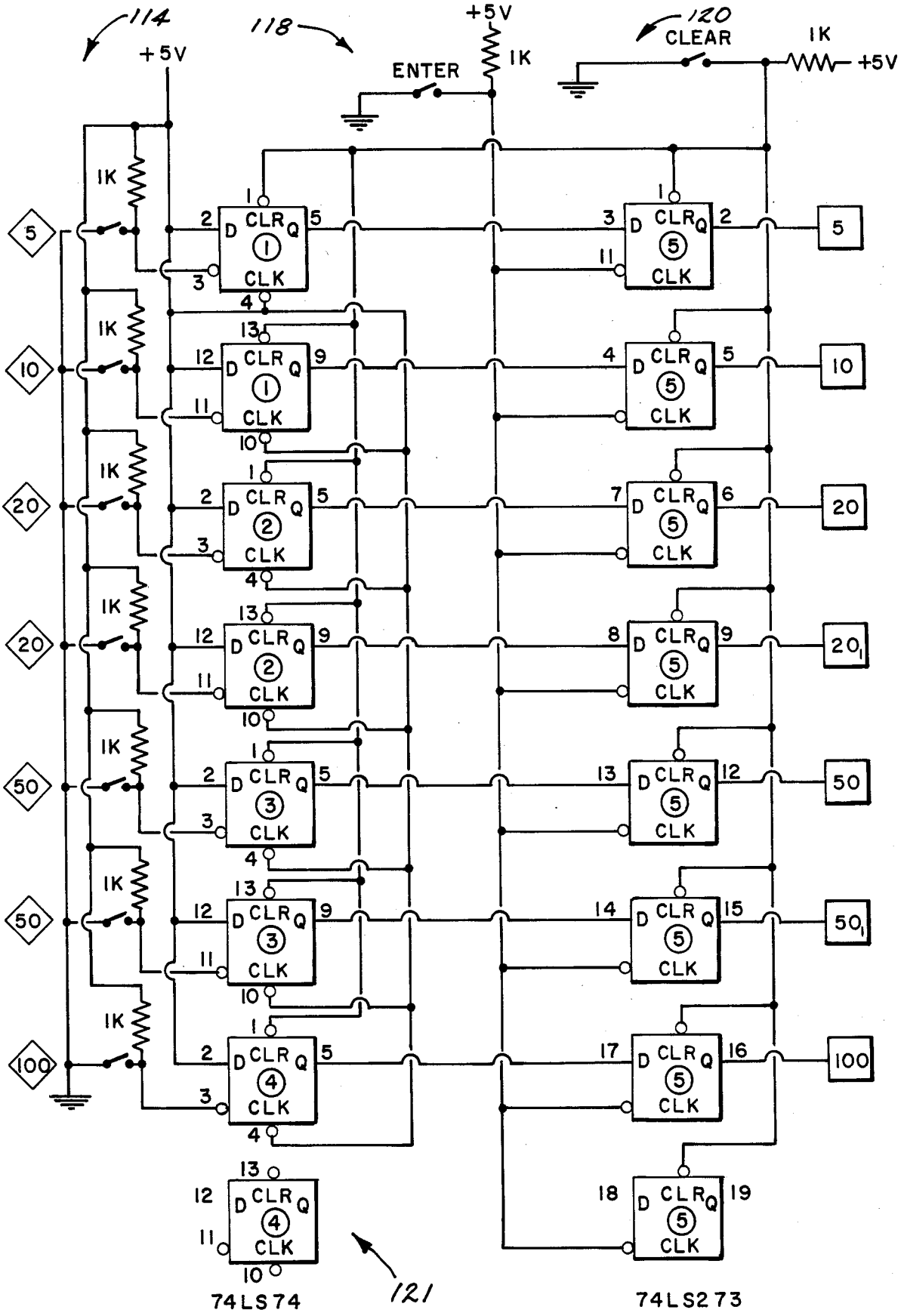
FIGS. 6–8 are electronic schematic diagrams of the electronic units of the present invention.
Figure 10:
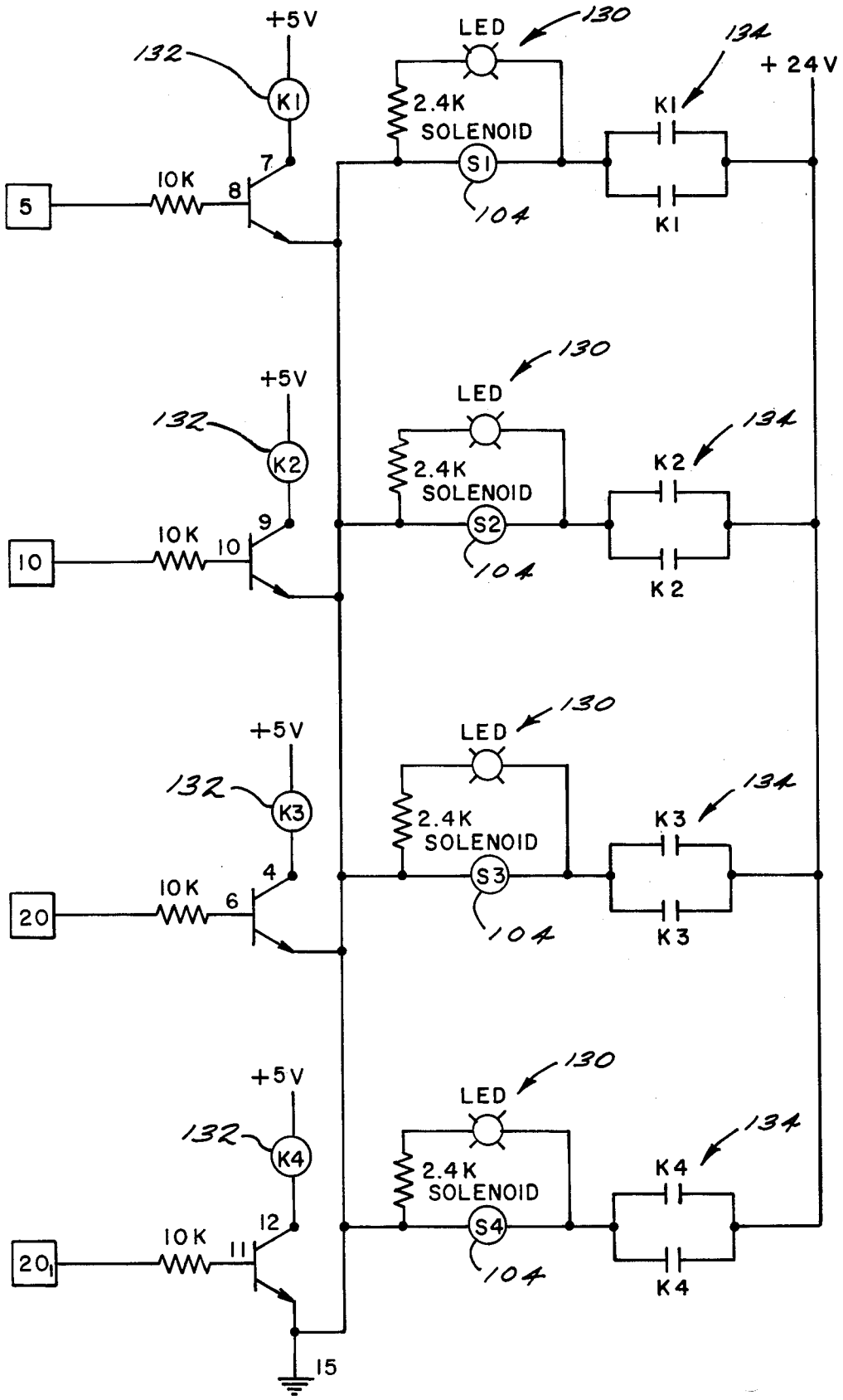
Figure 11:
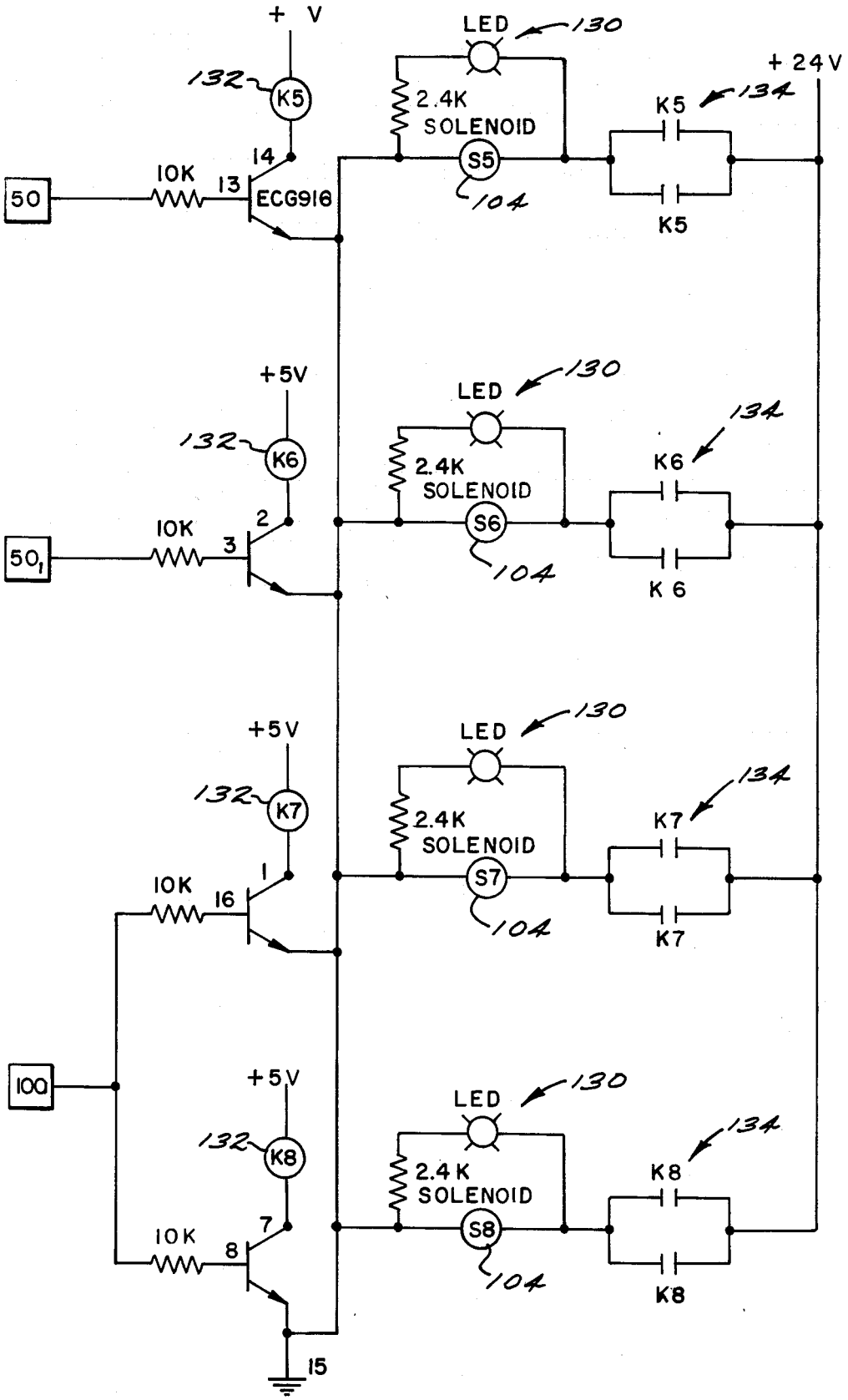

Referring now to FIG. 6, an electronic schematic of the latching section is shown. This section is tied directly to the key pad 114. It will be appreciated that key pad 114 is shown in FIG. 6 as represented by the seven number keys (circled units 5, 10, 20, 20, 50, 50 and 100). Also, the enter switch 118 and clear switch 120 make up a part of keypad 114. By consecutively depressing the "number" and "enter" keys 118, a desired weight can be selected and initially stored in IC chips 74 LS 74 (note that each IC chip 74 LS 74 is composed of two consecutive registers so that FIG. 6 depicts four (4) 74 LS 74 chips). This information is transferred to and stored in the single IC chip 74 LS 273; and sent to the encoding circuit (FIG. 7) and solenoid driver circuits (FIGS. 10 and 11). If a new selection is desired, the "clear" key 120 is depressed, which empties the contents of the latching circuit, making it ready to receive new data.

Figure 7:
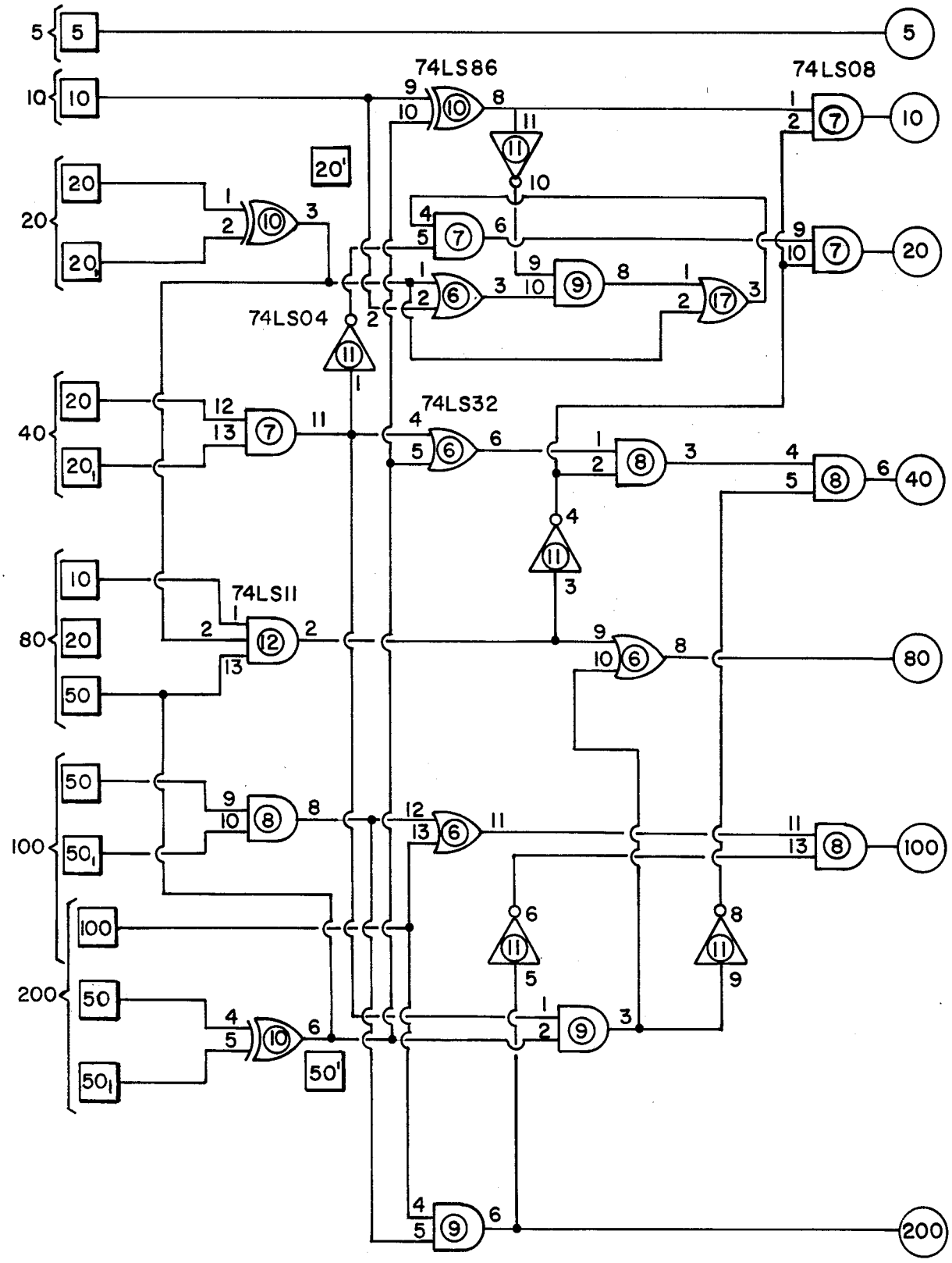
Figure 8A:
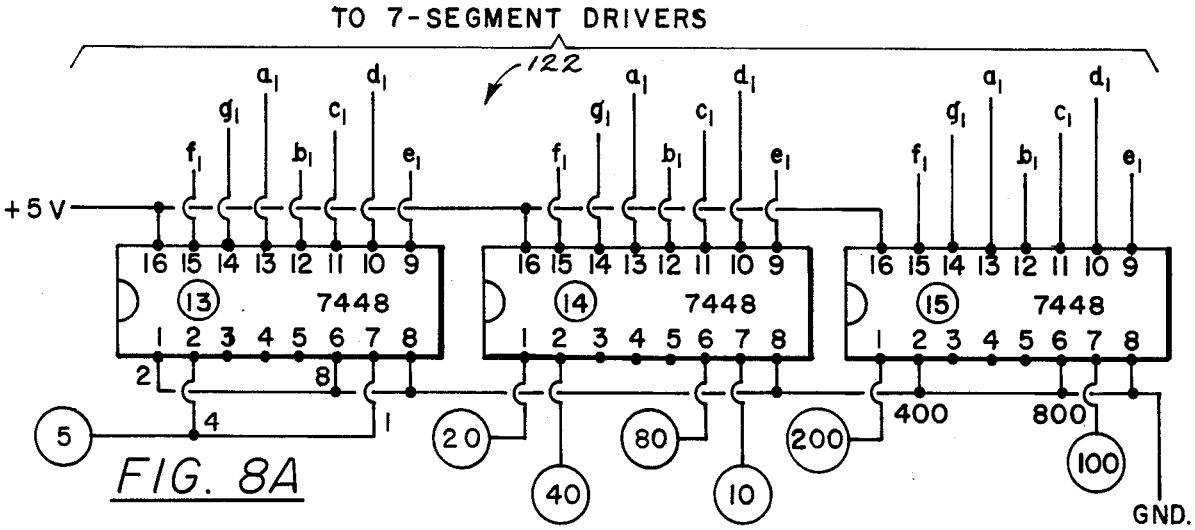
Figure 8B:
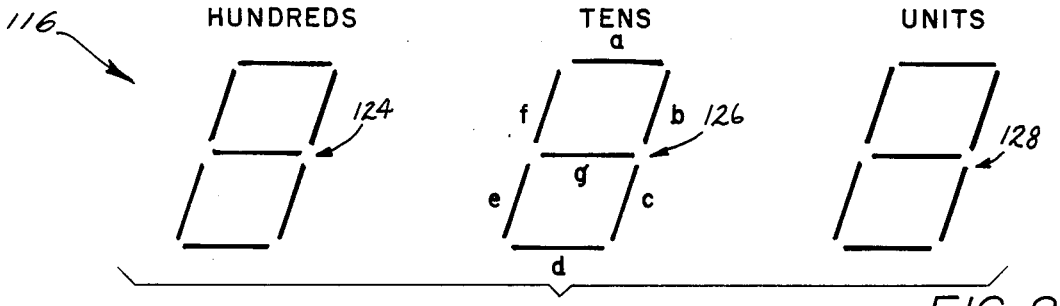
Figure 8C:
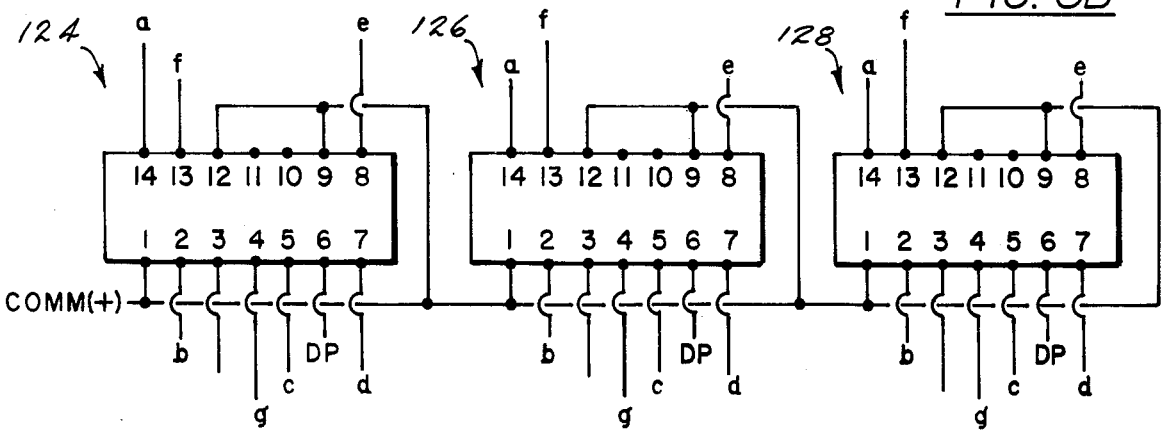
Figure 9:
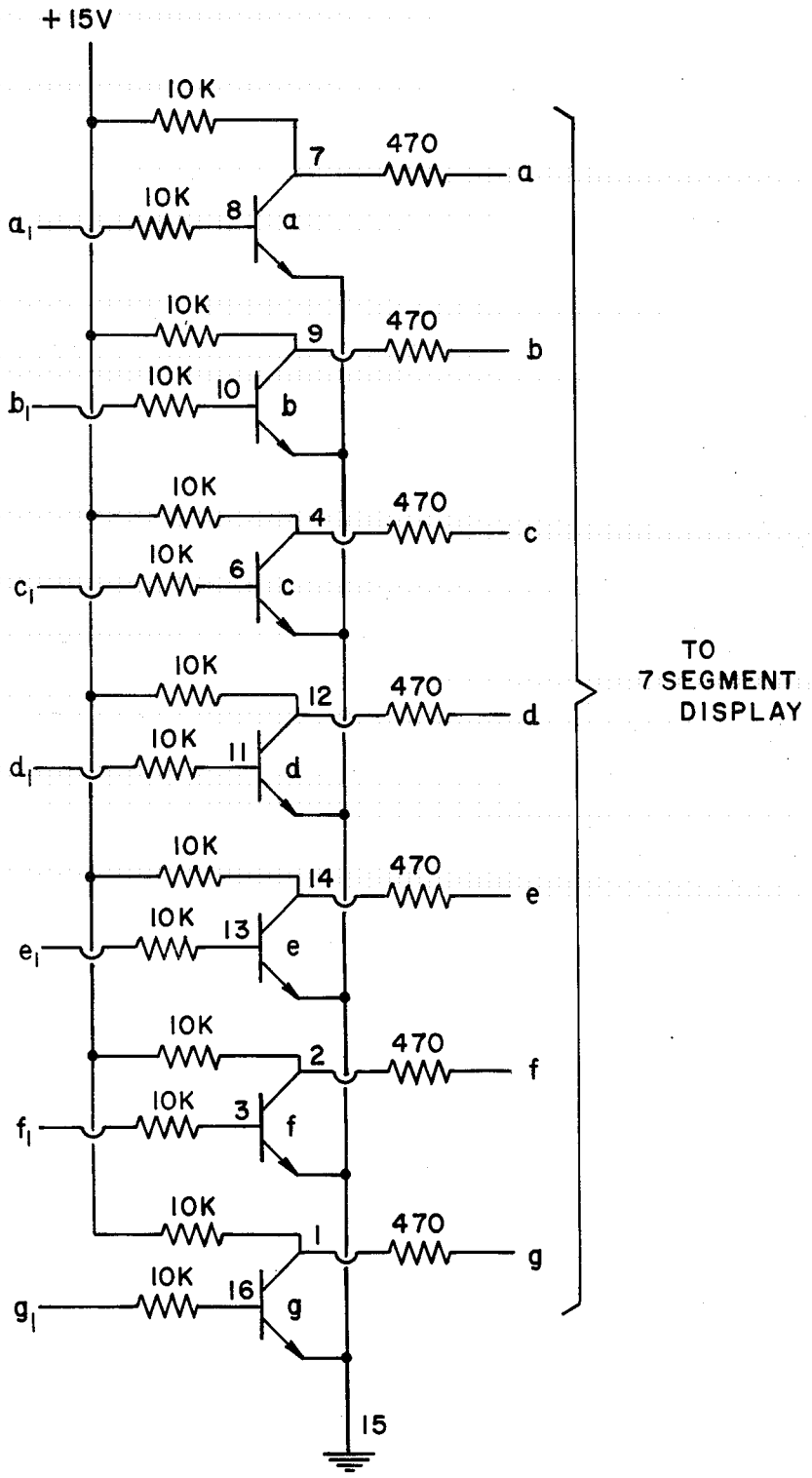

The encoding section is shown in FIG. 7. This section takes the signal from the information stored in IC chip 74 LS 273 (FIG. 6) and encodes this stored information to a "Binary-to-Decimal" (BCD) coding format in a manner well known to those or ordinary skill in the circuit design art. This permits the signals to be used in a BCD-to-7-segment decoder (FIG. 8A). The BCD signals are then sent to the BCD-to-7-segment decoder shown in FIG. 8A at 122. BCD-to-7-segment decoder 122 is a commercial unit comprised of three IC chips 7448. Each IC chip 7448 converts the BCD into a 7-segment display signal. Next, the 7-segment display signals are sent from decoder 122 to a 7-segment driver (FIG. 9) and finally to a digital readout 116 for a visual display of the selection made. The 7-segment driver of FIG. 9 is also a known commercial unit such as transistor ECG 916. Digital readout 116 is shown schematically in FIG. 8B. Each digital display has a respective pin socket 124, 126 and 128 (FIG. 8C) in a known manner with pin sockets 124, 126 and 128 corresponding respectively to the hundreds, tens and single units of the digital display 116 shown in FIG. 8B.

In FIGS. 10 and 11, the solenoid driver section is shown. This section is also comprised of a commercially available transistor ECG 916 and receives the signals from the latching circuit of FIG. 6 and supplies the power needed to energize the solenoids 104 when the selection of weight is made. The power is supplied as follows. An active signal from the latching circuit energizes a relay 132 so that its associated normally open contact 134 becomes closed. The closure of contact 134 applies power from the 24 volt power supply to energize the respective solenoid 104. Eight led's (light emitting diodes) 130 keep track of the status of all solenoids 104. Each led is assigned to a solenoid which represents a Particular weight, and just by looking at the lights, one can tell whether the signal to energize a given solenoid is or is not there. The presence of LED's 130 will assist a repairman in trouble shooting any malfunctioning of the unit. Thus, if a particular LED is activated, but the solenoid is malfunctioning the repairman would know that the problem is with the solenoid and not the electronic circuitry.

The power supply unit 42 uses a 120 voltage AC house power and converts it to a +5 v dc, 1 amp, to power the logic circuit, and +24 v dc, 4 amp, to energize the solenoids 104. Power unit 42 uses a three-wire power cable and is grounded to the metal frame 12 of the lifter machine. All the metal boxes that encase the logic circuit and solenoid drivers are also grounded to the metal frame of the excerciser machine. The grounding of the metal boxes is necessary to prevent electrical shock if one of the boxes (for whatever reason) contacts the "hot" side of the incoming power line.

The operation of the weight lifting device of the present invention is as follows:

Once a desired weight has been selected through the key pad 114, the weight is displayed. The key pad has seven entry keys. If one hundred fifty pounds is selected, the fifty and one hundred key is depressed. If two hundred pounds is selected, one hundred and both fifty keys are depressed. The clear key 120 is used to deactivate previous entry and allow for a new entry.

The electronic logic detects the key pad entry, energizing the selector solenoids engaging those selectors necessary for the desired combination of tension springs 60–66. If a different weight is desired, the clear key 120 on the key pad is used to disengage the selector units allowing for a new combination of weights. As mentioned, in a preferred embodiment, there are eight tension spring units, four fifty, two twenty, one ten and one five pound unit.

The operation of the tension springs is to extend the mounted cable or chain to the length required to reach the desired weight. It will be appreciated that normal spring units of the type described above require a relatively long extension to reach forces sufficient for weight lifting. For example, in order to reach fifty pounds on a fifty pound unit, the cable or chain must be pulled to a length of 144 inches (see FIG. 5 which is a graph of pounds vs inches extension for Ametek arbor mounted reels, models ML-2801 and MI-2800, published by Hunter Spring Products of Sellersville, Pa.). However, when operating the present invention, the user will only extend the cable from the spring unit about an arm's length (equal to about 2–2½ feet). Because of the long distance required to reach this weight (144 inches) and the much shorter distance of an arm's length (24–32 inches), the cable must be cut to the dimension required to reach a maximum arm reach, plus the distance from the lift arm 46 to the tension springs. As a result, a length of the cable from a commercial spring unit must be cut. Looking at the graph in FIG. 5, about ninety inches of cable length is cut so that zero point now comes at 90 to 100 inches extension for a constant pressure of twenty six pounds. Thus, each unit will have a constant pressure of some kind because of the cut cable length. Because of the constant pressure applied on each tension spring the need for a support is required. This support is provided by the selector base 82.

The function of selector base 82 is to guide and support the tension springs which are held in position by the selector arm 96 as shown in detail in FIG. 3. The selector base 82 moves back and forth along channels 86 and pivots to follow the arc created when the lift arm 46 is in operation. The movement and pivot of the selector arms 96 is allowed by the trucks 88 and 90, which are mounted in the channels 86 of frame 12. The selector base 82 also acts as home position for the selector arm units.

When the lift arm is in the home position (beneath the selector base 82), the lift arm is then ready to engage those spring units actuated or selected by the solenoids. The spring unit selection is developed by the selector solenoids 104. As mentioned, these solenoids are tied directly to the electronic logic and key pad. When a solenoid is deactivated, return springs 109 will urge selector arms 96 to disengage the previously selected spring unit.

Thus, by keying in a selected weight, the appropriate solenoids are activated whereby the selector arms 96 will actuate corresponding spring units. The combination of spring units activated by arms 96 will equal the previously selected weight. The user then lifts up on lifting arm 46. Lifting arm 46 will pivot about pivot pin 52 and selector base unit 82 (along with rotary bearing units 88 and 90) will move back and forth along channels 86 as the user lifts up and down in a known manner.

While the preferred embodiments h been shown for use as a bench press, it will be appreciated b of ordinary skill in the art that the present invention may used for many other weight lifting activities including curling, pull-overs, rowing and butterfly to name but a few.

It will be further appreciated each unit may be hooked into a larger computer unit which stores in memory all of the statistics on the individual including personal information (height, size, etc.) and exercise history. In this way, the user can get an update of his or her exercise program. This computer enhancement would include a CRT screen and printer for inputting and outputting data.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Weight lifting apparatus comprising:

rigid support frame means;

a plurality of spring loaded tension units mounted on said support frame means, each of said tension units including a pre-determined length of cable;

lifting frame means pivotally mounted on said support frame means and connected to said pre-determined length of cable from each of said spring loaded tension units;

selection means for selecting a lifting weight, said selection means selectively engaging said pre-determined length of cable from at least one spring loaded tension unit, said selection means being operatively connected to said lifting frame means; and control means for controlling and actuating said selection means.

2. The apparatus of claim 1 wherein each of said spring loaded tension units comprises:

an arbor;

a reel mounted on said arbor; and wherein said pre-determined length of cable is wound about said reel and said pre-determined length of cable is biased, such that said pre-determined length of cable exerts an increasing force as it is unwound from said reel.

3. The apparatus of claim 2 wherein each of said spring loaded tension units is keyed to a shaft and wherein:

said shaft is fixedly mounted in said support frame means;

4. The apparatus of claim 1 wherein:

each of said spring loaded tension units is biased to a pre-selected tension.

5. The apparatus of claim 1 wherein:

said selection means comprises a plurality of solenoids, one each of said solenoids actuating one each of said spring loaded tension units.

6. The apparatus of claim 5 wherein:

said solenoid units are mounted on said lifting frame means.

7. The apparatus of claim 5 wherein each of said solenoids includes:

a solenoid arm extending from the solenoid, said solenoid arm engaging said pre-determined length of cable from one of said spring loaded tension units subsequent to said one of said spring loaded tension units being actuated by said control means.

8. The apparatus of claim 7 further including:

return spring means on each of said solenoid arms for disengaging each of said solenoid arms from said pre-determined length of cable.

9. The apparatus of claim 1 wherein:

said lifting frame means comprises a fork teminating at a pair of handles on a first end and having a U-shape at a second end opposed from said first end.

10. The apparatus of claim 9 wherein said support frame includes a pair of opposed side members, each of said side members including an opposed track, and wherein:

said selector base unit is operatively connected to said tracks to move back and forth in said tracks when said lifting frame means is pivoted in said support frame means.

11. The apparatus of claim 1 wherein said control means comprises:

keyboard means for inputting a selected lifting weight;

digital display means for displaying said selected lifting weight; and electronic circuit means for actuating said selection means for obtaining said selected lifting weight.

12. The apparatus of claim 11 wherein said selection means comprises a plurality of solenoids and said electronic circuit means comprises:

latching means for storing said selected lifting weight input from said keyboard means; and solenoid driver means for actuating selected solenoids for obtaining said selected lifting weight.

13. The apparatus of claim 12 wherein said electronic circuit means further comprises:

encoding means for encoding said selected lifting weight to a binary-to-decimal coding format;

BCD-to-7-segment decoder means for converting the binary-to-decimal coding format into a 7-segment display signal; and 7-segment driver means for receiving the 7-segment display signal, said 7-segment driver means communicating with said digital display means.

14. The apparatus of claim 1 wherein said selection means includes:

a selector base unit for supporting and retaining said pre-determined length of cable from said spring loaded tension units.

* * * * *